US007976305B2

(12) United States Patent
Lin

(10) Patent No.: US 7,976,305 B2
(45) Date of Patent: Jul. 12, 2011

(54) CIGARETTE LIGHTER WITH ALARM

(75) Inventor: Arlo H. T. Lin, Road Town (VG)

(73) Assignee: Pro-Iroda Industries, Inc., Taichung (TW)

( * ) Notice: Subject to any disclaimer, the term of this patent is extended or adjusted under 35 U.S.C. 154(b) by 1618 days.

(21) Appl. No.: 10/814,565

(22) Filed: Mar. 31, 2004

(65) Prior Publication Data

US 2004/0185407 A1 Sep. 23, 2004

Related U.S. Application Data

(63) Continuation-in-part of application No. 10/316,704, filed on Dec. 11, 2002, now abandoned.

(51) Int. Cl.
*F23D 5/12* (2006.01)

(52) U.S. Cl. ..... 431/153; 431/253; 431/14; 431/13

(58) Field of Classification Search ..... 431/253, 431/14, 17, 13, 134, 153
See application file for complete search history.

(56) References Cited

U.S. PATENT DOCUMENTS

| | | | | |
|---|---|---|---|---|
| 2,921,495 | A * | 1/1960 | Ichikawa | 84/95.2 |
| 3,816,057 | A * | 6/1974 | Semenko | 431/253 |
| 4,311,448 | A | 1/1982 | Strauss | |
| 5,228,848 | A | 7/1993 | Kim | |
| 6,142,766 | A * | 11/2000 | Hu | 431/132 |
| 6,503,076 | B1 | 1/2003 | Lauterbach | |
| 6,527,542 | B1 * | 3/2003 | Chen | 431/153 |
| 2001/0034002 | A1 | 10/2001 | Jager-Muench | |
| 2002/0119411 | A1 | 8/2002 | Trober | |

FOREIGN PATENT DOCUMENTS

JP 11051391 * 2/1999

* cited by examiner

*Primary Examiner* — Alfred Basichas
(74) *Attorney, Agent, or Firm* — Alan Kamrath; Kamrath & Associates PA

(57) ABSTRACT

A cigarette lighter includes a reservoir for storing fuel and a head formed on the reservoir. Moreover, the cigarette lighter includes a valve for releasing the fuel from the reservoir, a nozzle put in the head for spraying the fuel from the valve, an ignition device for igniting the fuel sprayed from the nozzle, a cover for covering the head and an alarm for providing only one round of a message every time the cover is lifted.

17 Claims, 5 Drawing Sheets

CIGARETTE LIGHTER WITH ALARM

CROSS-REFERENCE

This patent application is a continuation-in-part application of U.S. patent application Ser. No. 10/316,704 filed on Dec. 11, 2002, now abandoned.

FIELD OF INVENTION

The present invention relates to a cigarette lighter and, more particularly, to a cigarette lighter equipped with an alarm.

BACKGROUND OF INVENTION

U.S. Pat. No. 5,228,848 discloses a conventional cigarette lighter 10 with message. The cigarette lighter 10 includes a lever 40 that can be pressed in order to ignite and a switch 50 that can be moved in order to provide a message. Whenever the lever 40 is pressed, the switch 50 is moved. That is, every attempt to ignite causes the message to be played once. It often happens that several attempts are made before ignition is achieved. Repeating of the message is annoying.

The present invention is therefore intended to obviate or at least alleviate the problem encountered in the prior art.

SUMMARY OF INVENTION

It is an objective of the present invention to provide a cigarette lighter equipped with an alarm for providing only one round of a message every time the cigarette lighter is opened for use.

According to the present invention, a cigarette lighter includes a reservoir for storing fuel and a head formed on the reservoir. Moreover, the cigarette lighter includes a valve for releasing the fuel from the reservoir, a nozzle put in the head for spraying the fuel from the valve, an ignition device for igniting the fuel sprayed from the nozzle, a cover for covering the head and an alarm for providing only one round of a message every time the cover is lifted.

Other objectives, advantages, and novel features of the invention will become more apparent from the following detailed description when taken in conjunction with the attached drawings.

DETAILED DESCRIPTION OF PREFERRED EMBODIMENT

Figure 1:
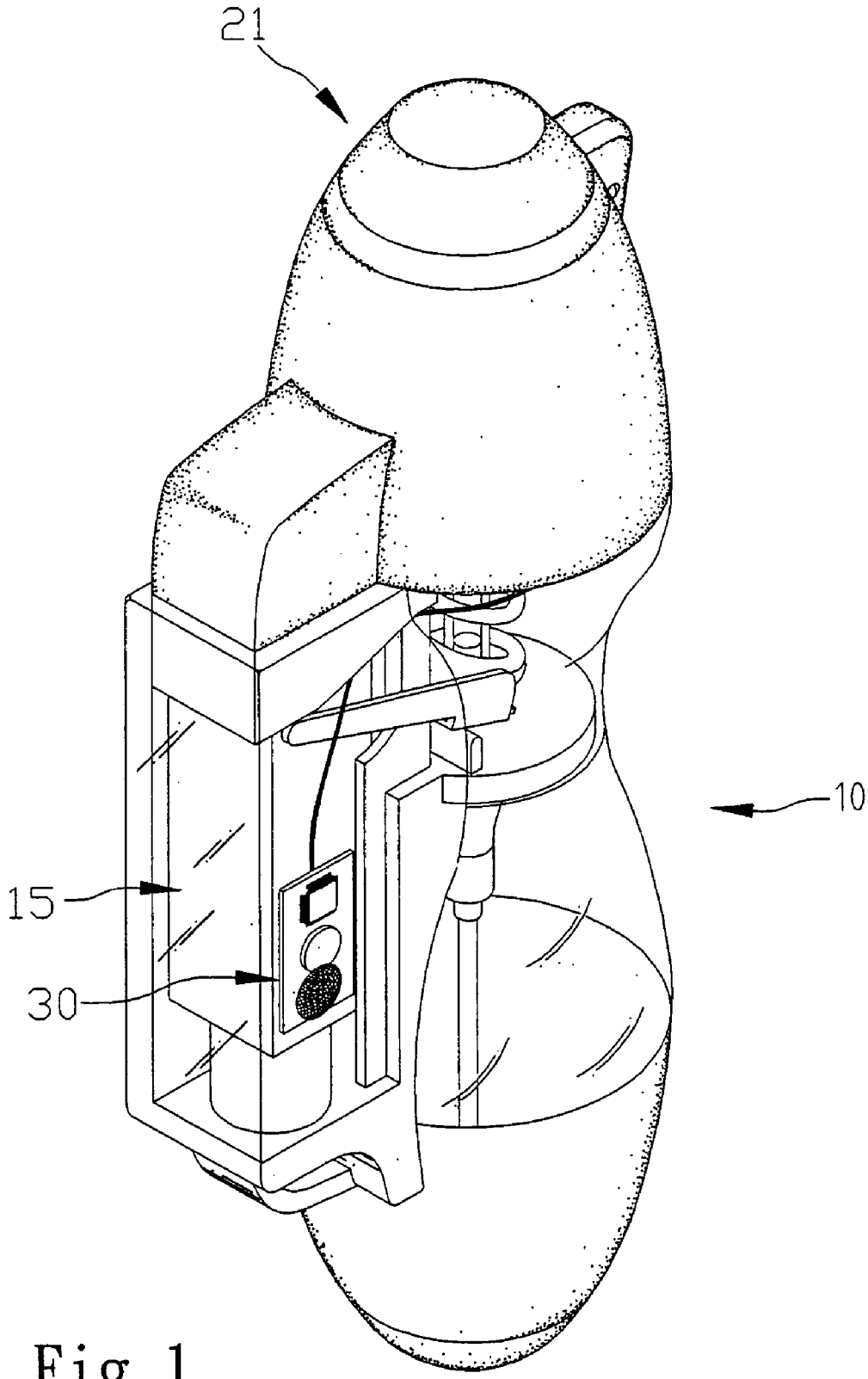
FIG. 1 is a perspective view of a cigarette lighter equipped with an alarm according to the preferred embodiment of the present invention.

FIG. 1 shows a cigarette lighter 10 equipped with an alarm 30 according to the preferred embodiment of the present invention.

Figure 2:
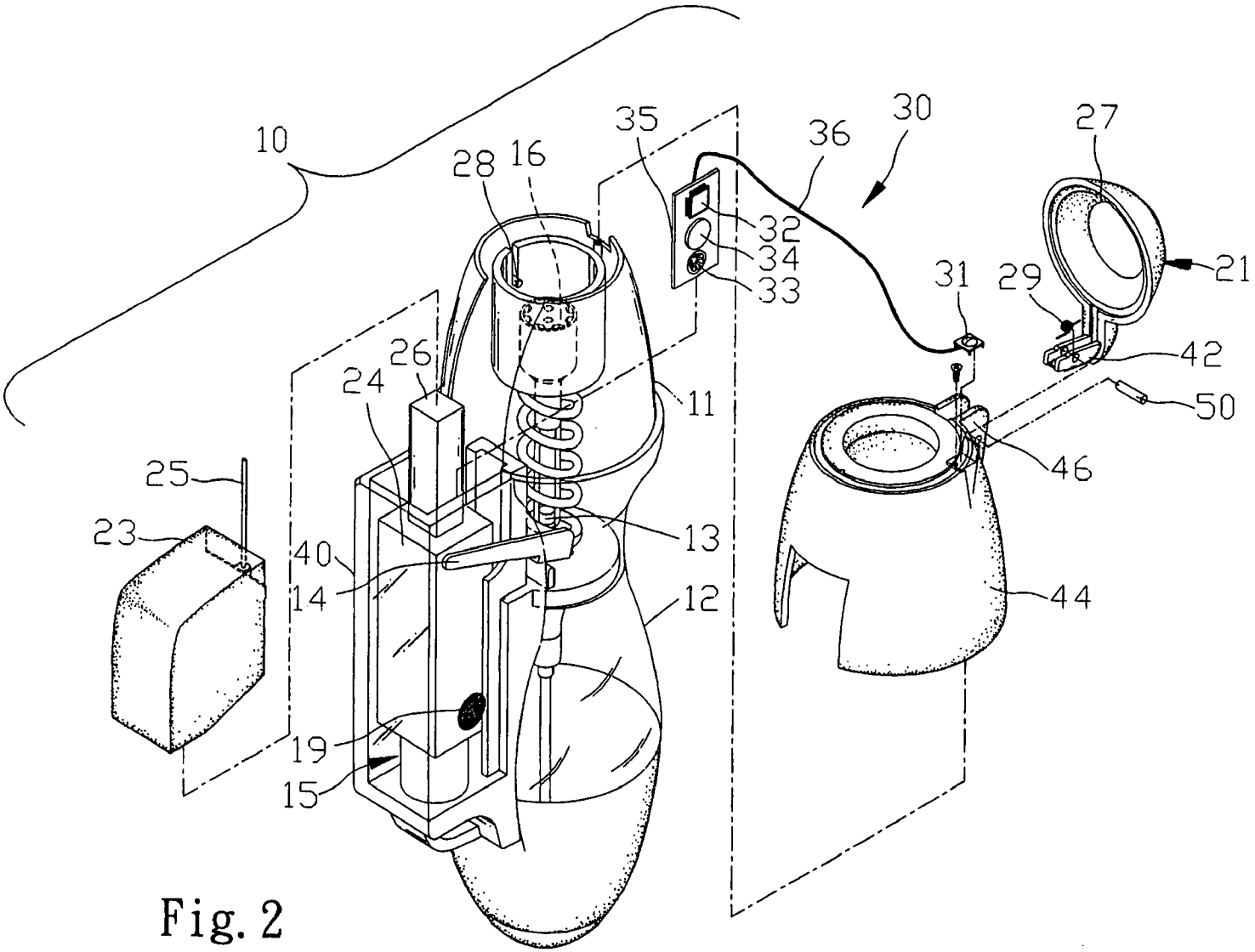
FIG. 2 is an exploded view of the cigarette lighter shown in FIG. 1.

Referring to FIG. 2, the cigarette lighter 10 includes a reservoir 12 for storing fuel, a head 11 formed on the reservoir 12 and a container 40 integrated with the reservoir 12. Moreover, the cigarette lighter 10 includes a valve 13 for releasing the fuel from the reservoir 12, a lever 14 for controlling the valve 13, a nozzle 16 for spraying the fuel from the valve 13, an ignition device 15 for igniting the fuel sprayed from the nozzle 16, a cover 21 for controlling the head 11 and an alarm 30.

The ignition device 15 includes a body 24, a button 26 in the form of a plunger extending into the body 24 and an electrode 28 extending from the body 24 to the vicinity of the nozzle 16. In the body 24 is arranged a circuit (not shown) from which the electrode 28 extends. When the button 26 is pushed, a voltage is produced by the circuit. Thus, an electric arc appears between the electrode 28 and the nozzle 16.

On the button 26 is installed an external button 23 for contact with a user's thumb. A rod 25 extends from the external button 23.

The cover 21 includes two ears 42 extending from a side. A collar 44 is installed on the head 11. The collar 44 includes two ears 46 extending from a side. The ears 42 are pivotally connected with the ears 46 by a pin 50. The cover 21 defines, in an edge, a hole 27 in which the rod 25 can be fit so as to keep the cover 21 closing the collar 44. A torque spring 29 is installed on the pin 50 for snap-opening the cover 21.

The alarm 30 includes a switch 31 installed on the collar 44 between the ears 46, a circuit board 35 put in the container 40 and a wire 36 leading to the switch 31 from the circuit board 35. A chip 32, a speaker 33 and a battery 34 are installed on the circuit board 35. The chip 32 and the speaker 33 are powered by the battery 34. When the circuit board 35 is put in the container 40, the speaker 33 is aligned with an aperture (not numbered) that is defined in the container 40 and is covered by a screen 19.

Figure 3:
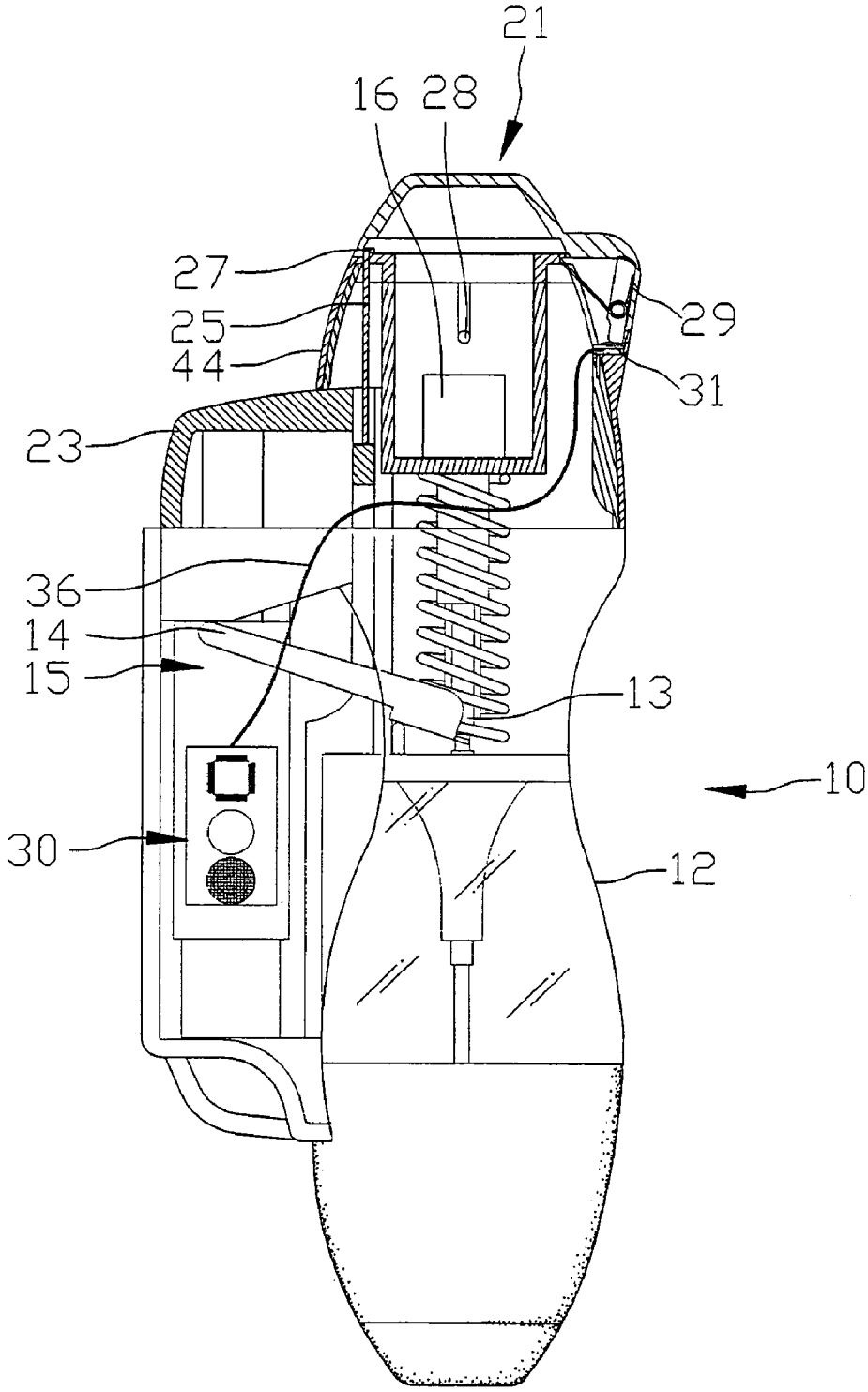
FIG. 3 is a cutaway view of the cigarette lighter shown in FIG. 1.

Referring to FIG. 3, the collar 44 is closed by the cover 21 as the rod 25 is fit in the hole 27.

Figure 4:
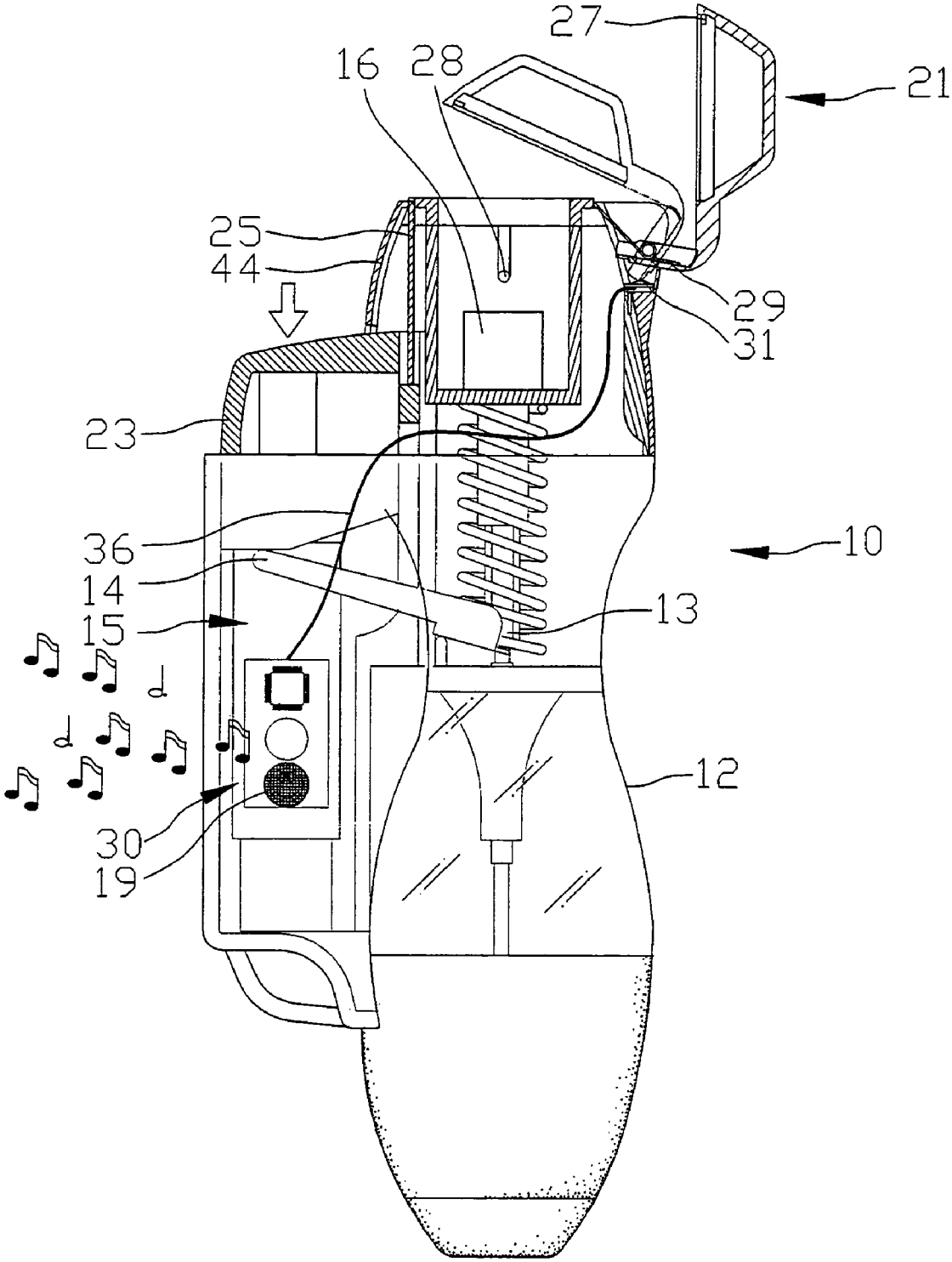
FIG. 4 is similar to FIG. 3 but shows the cigarette lighter in an open position so that the alarm provides only one round of a message before an attempt to ignite is made.

Referring to FIG. 4, the external button 23 can be pushed so as to pull the rod 25 from the hole 27. The cover 21 is snap-opened by the torque spring 29. The switch 31 is pushed by the ears 42 so that a round of a message is played through the speaker 33.

Figure 5:
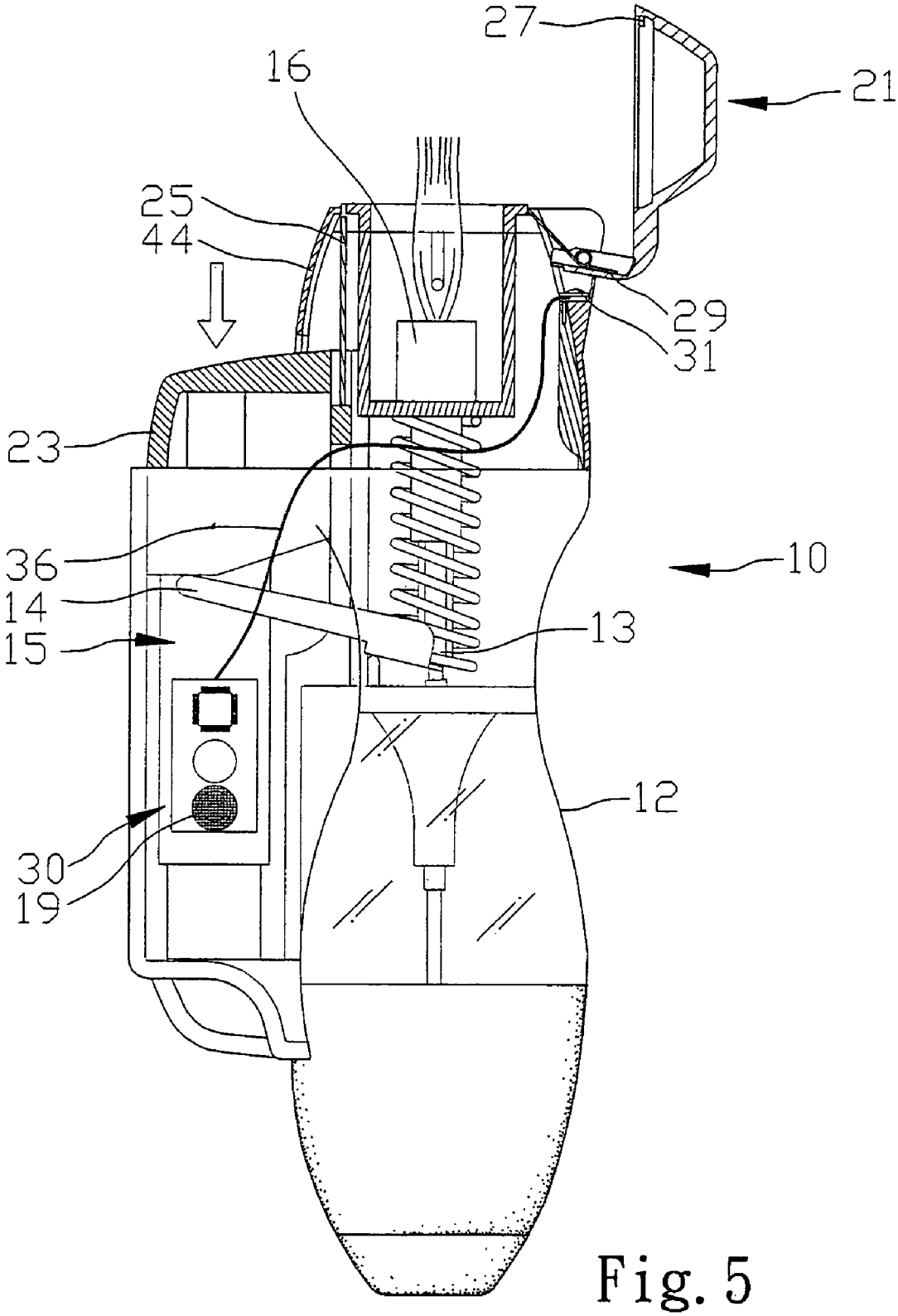
FIG. 5 is similar to FIG. 4 but shows that the round of the message is stopped and ignition is achieved.

Referring to FIG. 5, the external button 23 can be pushed hard so as to push the button 26 in order to ignite. No matter how many times the external button 23 is pushed hard for ignition, no round of the message will be played since the switch 31 is not connected with the external button 23 in any way.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

The invention claimed is:

1. A cigarette lighter including a reservoir for storing fuel, a head formed on the reservoir, a valve for releasing the fuel from the reservoir, a nozzle put in the head for spraying the fuel from the valve, an ignition device for igniting the fuel sprayed from the nozzle, a cover for covering the head and an alarm for providing only one round of a message every time the cover is lifted, wherein the ignition device includes a body, a button extending from the body, an external button installed on the button and a rod extending from the external button, wherein the cover includes, in an edge, a hole for receiving the rod so as to lock the cover in a closed position.

2. The cigarette lighter according to claim 1 including a collar installed on the head in order to support the cover.

3. The cigarette lighter according to claim 2 wherein the collar includes two ears wherein the cover includes at least one ear put between and pivotally connected with the ears of the collar.

4. The cigarette lighter according to claim 3 including a pin for pivotally connecting the ear of the cover with the ears of the collar.

5. The cigarette lighter according to claim 4 including a spring arranged between the cover and the collar so as to bias the cover to the open position.

6. The cigarette lighter according to claim 2 including a spring arranged between the cover and the collar so as to bias the cover to the open position.

7. A cigarette lighter including a reservoir for storing fuel, a head formed on the reservoir, a valve for releasing the fuel from the reservoir, a nozzle put in the head for spraying the fuel from the valve, an ignition device for igniting the fuel sprayed from the nozzle into a flame, a cover for covering the head and an alarm for providing only one round of an audible message every time the cover is lifted, with the alarm including a speaker providing the only one round of the audible message, with the cover being lifted for an ignition time to ignite the fuel and to use the flame, with the only one round of the audible message being of a duration less than the ignition time.

8. The cigarette lighter according to claim 7 including a container integrated with the reservoir, wherein the ignition device is put in the container and includes an electrode extending to the vicinity of the nozzle.

9. The cigarette lighter according to claim 7 including a lever for controlling the valve.

10. The cigarette lighter according to claim 7 wherein the alarm includes a switch for contact with the cover when the cover is lifted.

11. The cigarette lighter according to claim 7 including a collar installed on the head in order to support the cover.

12. The cigarette lighter according to claim 11 wherein the collar includes two ears wherein the cover includes at least one ear put between and pivotally connected with the ears of the collar.

13. The cigarette lighter according to claim 12 wherein the switch installed between the ears of the collar for contact with the ear.

14. The cigarette lighter according to claim 12 including a pin for pivotally connecting the ear of the cover with the ears of the collar.

15. The cigarette lighter according to claim 14 wherein the cover includes two ears.

16. The cigarette lighter according to claim 14 including a spring arranged between the cover and the collar so as to bias the cover to the open position.

17. The cigarette lighter according to claim 16 including the spring is a torque spring installed on the pin.

* * * * *